US005784342A

United States Patent [19]

Genta

[11] Patent Number: 5,784,342

[45] Date of Patent: Jul. 21, 1998

[54] TIMEPIECE AND, IN PARTICULAR, A WRIST WATCH

[75] Inventor: Gerald Genta, Monaco, Monaco

[73] Assignee: Gerald Genta S.A., Geneva, Switzerland

[21] Appl. No.: 794,757

[22] Filed: Feb. 3, 1997

[30] Foreign Application Priority Data

Feb. 1, 1996 [CH] Switzerland ..... 264/96

[51] Int. Cl.[6] ..... G04B 27/08

[52] U.S. Cl. ..... 368/76; 368/110; 368/112

[58] Field of Search ..... 368/76, 112, 110

[56] References Cited

U.S. PATENT DOCUMENTS

| | | | |
|---|---|---|---|
| 4,050,234 | 9/1977 | Dubois et al. | 368/110 |
| 4,389,122 | 6/1983 | Toshio | 368/112 |
| 5,235,562 | 8/1993 | Vaucher | 368/76 |
| 5,339,293 | 8/1994 | Kamiyama et al. | 368/21 |

*Primary Examiner*—Bernard Roskoski
*Attorney, Agent, or Firm*—Young & Thompson

[57] ABSTRACT

The control mechanism for displaying hours and minutes includes a tilting member (15) biasing against, under the effect of a return spring and via a pawl (18), a spirally shaped cam (12) located at the center of the movement, and which makes a full rotation in one hour. The tilting member (15) is lifted progressively by the action of the cam (12) to fall back instantly, once each hour. During this instantaneous falling back motion of the tilting member (15), a toothed sector (23) carried by the same drives, via a train of gears (24, 25, 26), a central pinion (27) carrying the minute hand. Thus, once at each hour, the minute hand is instantly reset to its initial position. The tilting member (15)carries a pawl (30) cooperating, at each of the instant falling back motions of the tilting member, with a star wheel with twelve branches, which rotates at the center of the movement and which carries a disk indicating hours, of which the display it thus of the so-called "incremental" type.

8 Claims, 2 Drawing Sheets

FIG. 4
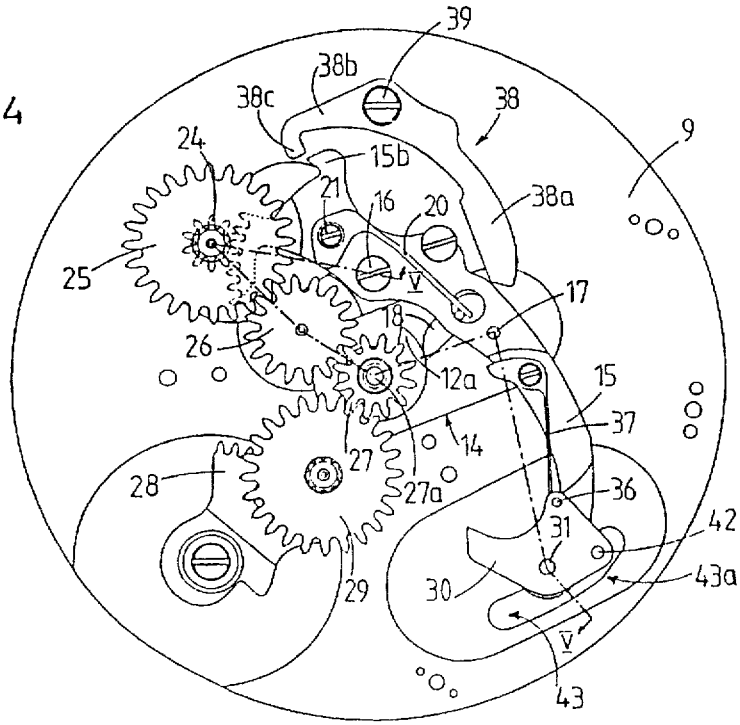
FIG. 5
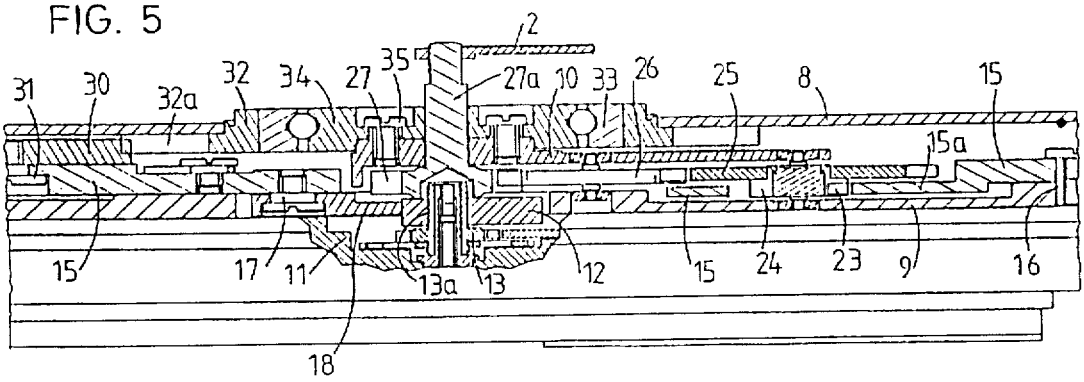
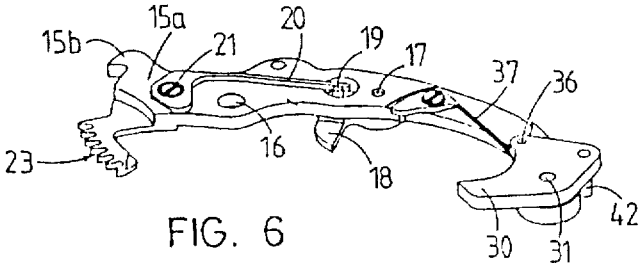
FIG. 6
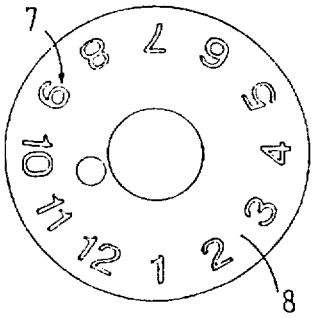
FIG. 7

TIMEPIECE AND, IN PARTICULAR, A WRIST WATCH

FIELD OF THE INVENTION

The object of the present invention is a timepiece and, in particular, a wrist watch, comprising a display means for hours, of the so called "incremental" type and a display means for minutes of the "reseting" type.

SUMMARY OF THE INVENTION

The objective of the invention is to provide a control mechanism for the two display means in such a timepiece which is reliable, simple and effective.

This objective is met by virtue of the means defined in claim 1.

BRIEF DESCRIPTION OF THE DRAWINGS

The annexed drawing illustrates, by way of example, an embodiment of the object of the invention.

FIG. 4 is a plan view of the mechanism as shown in FIG. 3, at a scale intermediate between those of FIG. 2 and FIG. 3.

FIG. 5 is a cross-sectional view taken along line V—V of FIG. 4, at an enlarged scale.

FIG. 6 is a perspective view of a detail of the control mechanism of the display means of the watch shown in FIG. 1, at an enlarged scale, and FIG. 7 is a view of an indicator member for this watch, substantially at the same scale as that of FIG. 1.

DETAILED DESCRIPTION OF THE INVENTION

Figure 1:
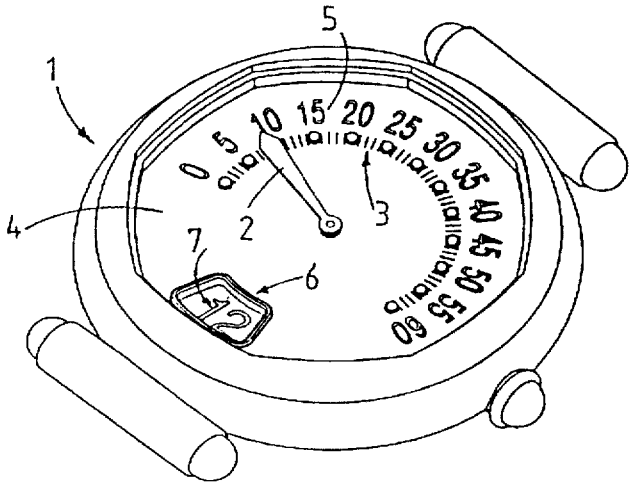
FIG. 1 is a perspective view of a wrist watch.

The watch shown in FIG. 1 and designated generally by 1, includes a minute hand 2 pivoting at the center of the piece and which moves along a scale 3 of sixty divisions indicating minutes, and having the shape of a sector of a circle extending over more than 180°, carried by the dial plate, designated by 4, and bearing the numerals 5 from 0 to 60.

The dial plate 4 has at six o'clock a window 6 through which are to be seen numerals 7 giving the hour of the day, carried by a disk 8 for indicating the hour of the day, which disk is shown separate in FIG. 7.

The driving mechanism for the hand 2 and for the hour disk 8 is carried by a frame consisting of a circular base plate 9 and of a bridge 10. This frame provides an independent module which is affixed to the movement of the watch, of which the mechanism plate is indicated by 11 (FIG. 5). The mechanism includes a spirally shaped cam 12 press fitted on a cannon 13*a* carried by the cannon pinion designated by 13. The spirally shaped cam 12 is housed in an elongated opening 14 provided in the base plate 9 of the frame of the mechanism.

The latter includes a main tilting member 15 pivotally mounted at 16 on the plate 9 and which carries, mounted pivotally at 17, a pawl 18 which is provided with a pin 19 extending through a hole of said tilting member and which is biased by the return spring 20 affixed at 21 to the tilting member. The pawl 18 is housed, as is the cam 12, in the opening 14 of the plate 9. The tilting member 15 is subjected to the action of a return spring 22, affixed to the base plate 9, which functions to maintain the tilting member engaged via its pawl 18, against the spirally shaped cam 12.

As it rotates, at the rate of one full rotation per hour, the tilting member 15 is lifted progressively by the cam 12, which causes its rotation in the counter clockwise direction, to fall back instantly, once each hour, when the nose, designated by 12*a* (FIG. 4) of the cam 12, drives over the pawl 18.

The tilting member 15 exhibits an extension 15*a*, toothed at 23, and forming a rake engaged with the pinion, designated by 24, of a movement, of which the wheel, designated by 25, rotates between the plate of the mechanism 9 and the bridge 10. The wheel 25 of the movement 24–25 is engaged with an intermediate wheel 26, which also rotates between the plate 9 and the bridge 10, and which is engaged with the minute wheel 27 integral with a shaft 27*a* pivotally mounted in the bridge 10, at the center of the movement. The minute hand 2 is carried by said shaft 27*a*.

During the slow displacements of the tilting member 15 produced by the spirally shaped cam 12, the rake 23 drives the shaft 27*a* via a train of gears as described above, to move the hand 2 progressively along the scale 3 of the dial 4. The gear ratio was selected in such a manner that, the slow displacement of the tilting member 15 having a duration of one hour, since the spirally shaped cam 12 is integral with the minute wheel 27 of the movement, the hand 2 take sixty minutes to cover the full scale 3, of sector 5 graduated in minutes from "0" to graduated in minutes, corresponds to the point of time when the nose 12*a* of the cam 12 rides over the pawl 18 of the tilting member 15. The latter then falls instantly back, under the effect of its return spring 22, which brings the minute hand 2 facing numeral "0" of the scale 5 graduated in minutes.

Accordingly, the minutes display is of the so-called "reseting" type.

One should note that the presence of the pawl 18 positioned between the spirally shaped cam 12 and the tilting member 15 makes it possible to reset time manually by a backward motion without causing any damage to the mechanism, the pawl 18 assuming at that time a retracted position, against the action of its return spring 20, by the action of the nose 12*a* of the cam 12 abutting against it.

One can also note that the minute wheel 27 is subjected to the action of a resilient return member designed for preventing any spontaneous reseting of the minute hand 2, which could be brought about by looseness in any set of gears of its drive train.

Figure 2:
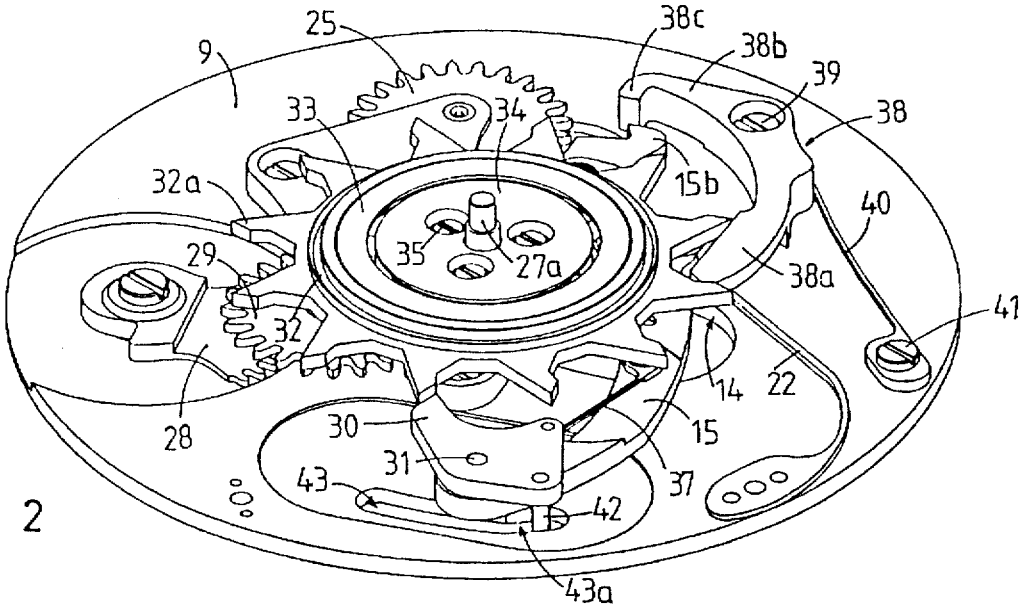
FIG. 2 is a perspective view of a part of the control mechanism for the display means of the watch shown in FIG. 1, at an enlarged scale.
Figure 3:
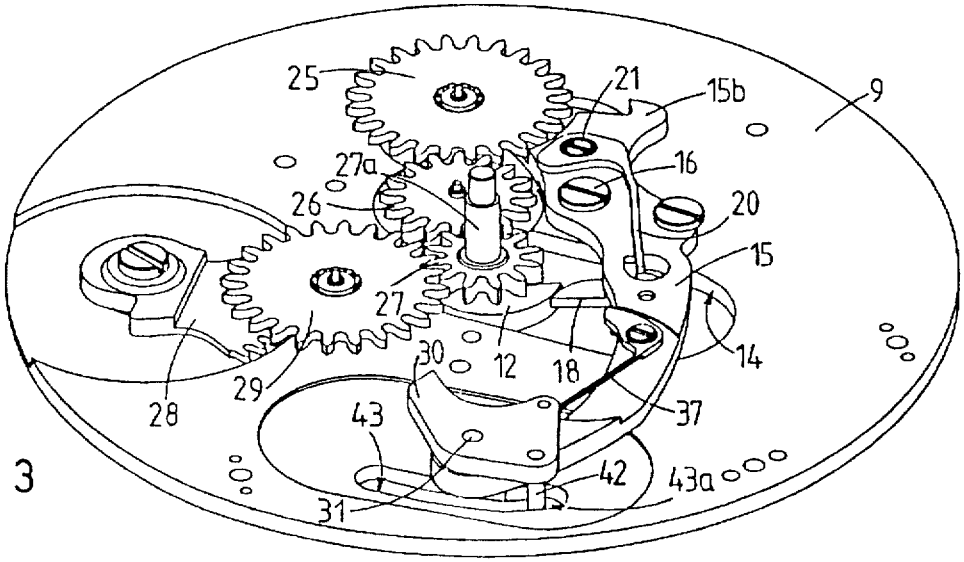
FIG. 3 is a perspective view, from a different angle, of the mechanism shown in FIG. 2, at the same scale as in FIG. 2, certain components of this mechanism being deleted, for sake of clarity of the drawing.

This return mechanism includes a toothed or rake shaped sector 28 (FIGS. 2, 3 and 4)) subjected to the action of a return spring (not illustrated) which is engaged with a pinion (not illustrated in the drawing) situated beneath the wheel 29, with which it is integral, and which is in turn engaged with the minute wheel 27. The latter is thus biased, in the same direction, by the return spring of the rake 28, thus preventing the accidental reseting of the minute hand 2.

The tilting member 15 carries a second pawl, designated by 30, pivotally mounted upon the same by means of a shank screw 31 and cooperating with the branches 32*a* of a star wheel 32, having 12 branches and carrying, press fitted thereon, an hour disk 8, which in turn is press fitted on the outer ring 33 of a ball bearing of which the central part, designated by 34, is affixed by screws 35 to the bridge 10, at the center of the movement. The pawl 30 carries a pin 36 with which cooperates a return spring 37 affixed to the tilting mechanism 15.

The mechanism further includes a tilting member 38 pivotally mounted on the plate of the frame 9 by means of a shank screw 39 and which is subjected to the action of a return spring 40 affixed at 41 to the plate 9. The tilting member 38 has two arms, of which one designated by 38*a*, is designed for cooperating with the branches 32*a* of the star wheel 32, to ensure the stability of the twelve incremental positions, at each one of which one of the numerals of the hour dial 7 appears in the window 6 of the display. At each instantaneous falling back of the tilting member 15, its pawl 30 biases one of the branches 32*a* of the star wheel 32, to displace the same in the clockwise direction until one of the branches 32*a* has overtaken the end of the arm 38*a* of the tilting member 38.

The mechanism further includes a double safety device preventing, in the case of a shock to the hour disk 8, an erratic displacement, by one increment or more.

To this end, the pawl 30 carries a pin 43 engaged in a slot 42 which is made in the plate 9 of the frame and which has the shape of an arc of a circle, of which the center coincides with the center of rotation 16 of the tilting member 15. In the case of a shock, tending to displace the star wheel 32, the pawl 30 will thus form a lock, its pin 42 abutting against the internal wall of the slot 43, which prevents the star wheel to move in an erratic manner.

When the tilting member 15 arrives close to the end of its slow travel produced by the spirally shaped cam 12, approximately ten minutes before its instantaneous falling back, the minute hand 2 then being approximately opposite numeral 50 of the scale 5 graduated in minutes, the pin 42 of the pawl 30 engages in the rectilinear end part, designated by 43*a* of the slot 43, which forms an angle relative to the main part of the slot, which is arc shaped. The pawl 30 is then free to move and is ready to cooperate with the star shaped wheel at the coming instantaneous falling back of the tilting member 15.

Another locking device then operates in place of that provided by the pawl 30, ensured by the second arm of the incremental tilting member 38, designated by 38*b*, which ends by a head 38*c* with which cooperates a protrusion 15*b* carried by the tilting member 15. The branch 38*a* of the incremental tilting member 38 is thus kept rigidly on the trajectory of the branches 32*a* of the star wheel 32, locking the same against the effects of possible shocks. At the point of time when the tilting member 15 proceeds to its instantaneous falling back, its protrusion 15*b* leaves the head 38*c* of the arm 38*b* of the tilting member 38, releasing the latter which can then function normally as an incremental member.

If, during this same period of about ten minutes before the instantaneous falling back of the tilting member 15, a shock tending to return the star wheel 32 in the backward direction is received, the part 38*a* of the incremental tilting member 38 being engaged with the star wheel, prevents the wheel from moving backwards.

The locking of the star wheel is thus complete, in both directions.

It should be noted that the control mechanism of the display means of the watch described and illustrated forms a single element carried by the plate 9 and the bridge 10, which can be placed on any type of watch movement, without having to subject the same to any transformation.

I claim:

1. A timepiece comprising a window for displaying the hours, in minute display of a "resetting" type, and a control mechanism which comprises a main tilting member subjected to the action of a rotatory control member, operating a full rotation each hour, said control member moving the main tilting member progressively against the bias of a return spring, then releasing it, once at each full rotation, so that the main tilting member returns to an original position by falling back instantly, said main tilting member being operatively connected to an element carrying an indicator which indicates a time from 0 to 60 minutes during the progressive movement of the main tilting member, said indicator returning instantly to the zero position by the instantaneous falling back motion, the main tilting member further cooperating, at each of its return movements, with a star wheel integrated with an hour member indicating hours so that once each hour, at each one of the instantaneous falling back motions, said hour member is driven by one step amounting to one hour increment.

2. A timepiece according to claim 1, wherein the rotatory control member is a spirally shaped cam integral with a minute wheel.

3. A timepiece according to claim 2, wherein the main tilting member carries a movable pawl, rotatably connected thereto, subjected to the action of a return spring, said tilting member biasing against said spirally shaped cam via said pawl.

4. A timepiece according to claim 1, wherein the main tilting member comprises a toothed sector engaged with a pinion belonging to a train of gears driving the element indicating minutes.

5. A timepiece according to claim 4, wherein the element carrying the indicator of minutes is subjected to the action of a resilient return member, preventing any return of said indicator which would be produced by looseness in said train of gears.

6. A timepiece according to claim 1, wherein said main tilting member carries a rotatably mounted pawl, subjected to the action of a return spring, which acts on the star wheel integral with the hour member.

7. A timepiece according to claim 6, further comprising a second tilting member subjected to the action of a return spring, said second tilting member cooperating, in an incremental manner, with said star wheel.

8. A timepiece according to claim 7, wherein the pawl driving the star wheel carried by the main tilting member cooperates with a fixed part which holds said pawl, in case of a shock, in a position in which said pawl is situated on a trajectory of branches of the star wheel to prevent the star wheel from moving by a value such that one of its branches would pass over the incrementally moving main tilting member, said fixed part being constructed and arranged such that, a short time before the main tilting member undergoes its instantaneous falling back motion, said pawl is free to move, the star wheel being then locked by a protrusion of the main tilting member cooperating with a protrusion of the second tilting member, to maintain the second tilting member rigidly engaged with the star shaped wheel, said second tilting member being released by the main tilting member at the instant of the instantaneous falling back motion.

* * * * *